US007691301B2

(12) United States Patent
Tyberghein

(10) Patent No.: US 7,691,301 B2
(45) Date of Patent: Apr. 6, 2010

(54) MULTI-CELLULAR CONTAINER WITH CUT-SCORE

(75) Inventor: Michael B. Tyberghein, Roswell, GA (US)

(73) Assignee: Anchor Packaging, St. Louis, MO (US)

( * ) Notice: Subject to any disclaimer, the term of this patent is extended or adjusted under 35 U.S.C. 154(b) by 0 days.

(21) Appl. No.: 12/328,312

(22) Filed: Dec. 4, 2008

(65) Prior Publication Data

US 2009/0082185 A1 Mar. 26, 2009

Related U.S. Application Data

(62) Division of application No. 11/397,192, filed on Apr. 4, 2006, now Pat. No. 7,549,551.

(51) Int. Cl.
*B31B 1/14* (2006.01)

(52) U.S. Cl. ..... 264/138; 264/294; 83/880; 83/881

(58) Field of Classification Search ..... 264/138, 264/294, 544; 83/879, 880, 881, 882, 883, 83/884, 885, 886, 887
See application file for complete search history.

(56) References Cited

U.S. PATENT DOCUMENTS 3,520,439 A 7/1970 Smith et al.
3,605,374 A * 9/1971 Mueller et al. ..... 53/399
3,738,566 A 6/1973 Foster
4,223,043 A 9/1980 Johnson
4,839,076 A 6/1989 Wilman et al.
5,118,202 A 6/1992 Bruno
5,427,830 A 6/1995 Pharo
5,441,345 A 8/1995 Garvey et al.
5,543,104 A * 8/1996 Stratford et al. ..... 264/328.8
5,664,670 A 9/1997 Cozzie
5,740,717 A * 4/1998 Sowden et al. ..... 83/879
6,070,723 A * 6/2000 Lewis ..... 206/335
2002/0015540 A1 2/2002 Price et al.
2003/0141218 A1 7/2003 Stephens et al.
2004/0022457 A1 2/2004 Brown et al.
2004/0164076 A1* 8/2004 Baker et al. ..... 220/23.4
2005/0063618 A1 3/2005 Lorsch
2007/0194495 A1* 8/2007 Henderson et al. ..... 264/319

* cited by examiner

*Primary Examiner*—Joseph S Del Sole
*Assistant Examiner*—Robert Dye
(74) *Attorney, Agent, or Firm*—Brian B. Diekhoff; Polsinelli Shughart PC

(57) ABSTRACT

A multi-cellular polypropylene container with a cut-scored region connecting the cells of the container is described. By varying the cut-score depths depending on the orientation of the plastic material, greater consistency in the tearability of the individual cells is achieved. One or more star-cut patterns may be provided between the cells. The star-cut patterns have curved edges that lead to the separation region. The curved edges provide a generally smooth surface that does not cut or snag the user.

18 Claims, 15 Drawing Sheets

MULTI-CELLULAR CONTAINER WITH CUT-SCORE

RELATED APPLICATION

This application is a divisional of U.S. application Ser. No. 11/397,192, filed Apr. 4, 2006.

FIELD OF THE INVENTION

The present invention relates to a multi-cellular polypropylene container with a separable region connecting the cells of the container.

BACKGROUND OF THE INVENTION

In the food packaging industry, there is a growing trend in the market for portion-control packaging. This is beneficial for convenience, lunches for children and adults, and caloric control.

Multi-cellular containers sold as a one-piece unit have been used in the yogurt industry. The cups are made from polystyrene and the consumer may remove one of the cells by bending along a cut-score of the package and breaking it off. This allows the consumer to open one cup at a time without disturbing the remaining cups, however, polystyrene is not suited for some food packaging applications. Polystyrene forms a poor moisture barrier. Polystyrene forms a brittle container, subject to cracking and breaking.

To date, no multi-cellular packages have been produced in polypropylene similar to the polystyrene yogurt cups. Attempts have been made to perforate polypropylene for use in multi-cellular containers, but this process leaves rough and sharp edges along the break region between the containers. These rough and sharp edges may cut or injure the user.

SUMMARY OF THE INVENTION

The present invention relates to a polypropylene multi-cellular container for storing food items. The multi-cellular container comprises a plurality of the cells that are connected together. An individual cell may be torn from the remaining cells. The individual cell torn from the remaining cells has generally smooth edges that are not prone to cutting the user, snagging the user's skin or clothes, or otherwise forming a sharp or serrated edge.

The present invention further includes a multi-cellular polypropylene container with a cut-scored region connecting the cells of the container. The multi-cellular container is formed from a sheet of plastic material. The multi-cellular container comprises a plurality of the cells connected together by a separation region. An individual cell may be removed by tearing the separation region between the individual cell and the plurality of cells. The separation region comprises a cut-score. The cut-score may have different depths; the cut-score being deeper in an index direction of the plastic material, and the cut-score being shallower when the cut-score is generally perpendicular to the index direction. By varying the cut-score depths depending on the orientation of the plastic material, greater consistency in the tearability of the individual cells is achieved.

The present invention further includes a multi-cellular container that comprises a plurality of cells connected together by a separation region. A plurality of star-cut patterns are provided between the plurality of cells, and the star-cut patterns have curved edges that lead to the separation region. The curved edges provide a generally smooth surface that does not cut or snag the user.

The present invention further includes a multi-cellular container that comprises a plurality of cells connected together by a separation region, wherein an individual cell may be removed by tearing the separation region between the individual cell and the plurality of cells, the plurality of cells connected by a separation region, wherein the separation comprises a cut-score or a cut-score alternating with a cut-though, wherein an individual cell removed from the plurality of cells at the separation region has a perimeter formed from the separation region, wherein the perimeter has a generally smooth edge.

DETAILED DESCRIPTION OF EMBODIMENTS

Figure 1:
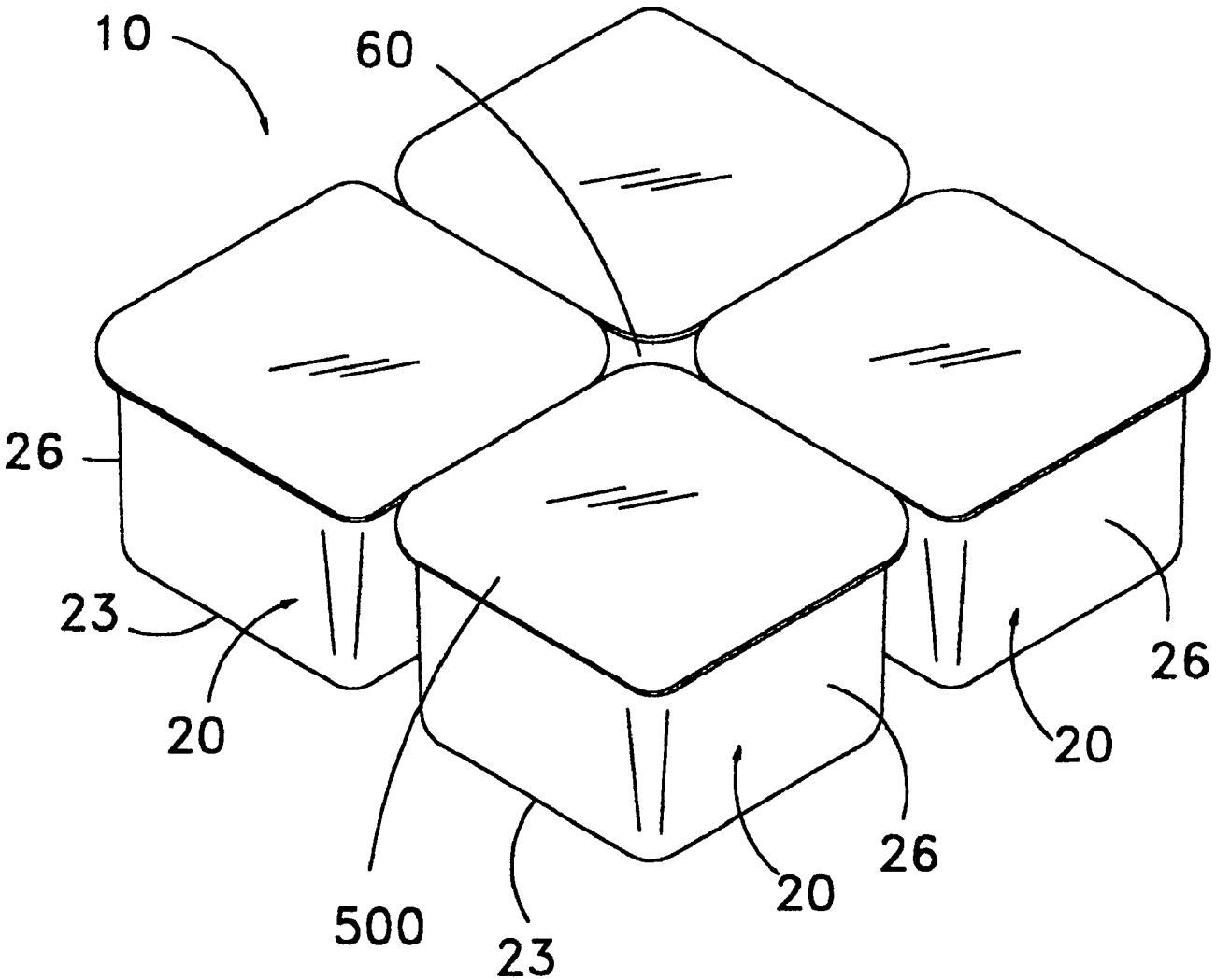
FIG. 1 is a perspective view of the multi-cellular container.
Figure 2:
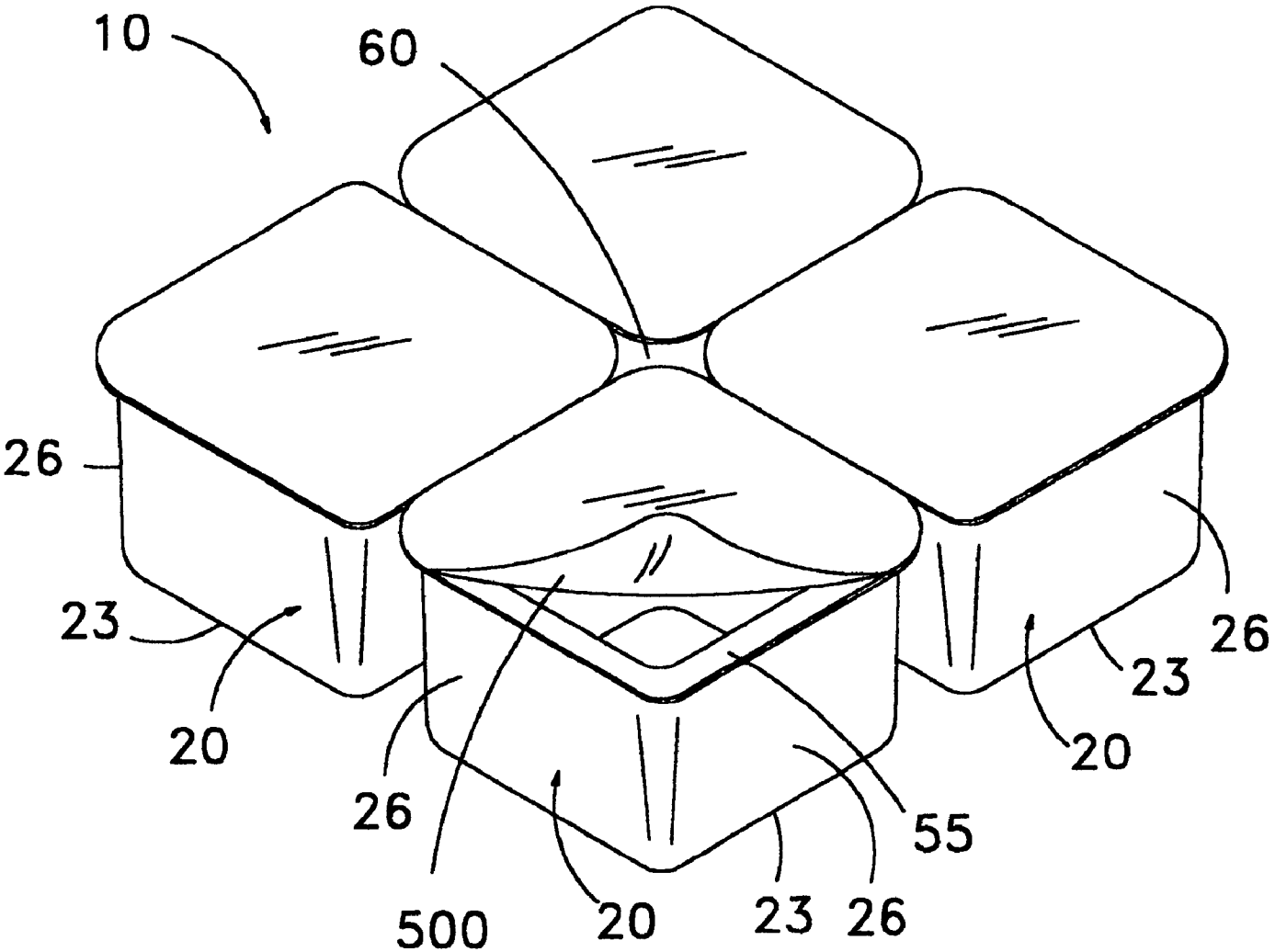
FIG. 2 is a perspective view of the multi-cellular container showing the film opened.
Figure 3:
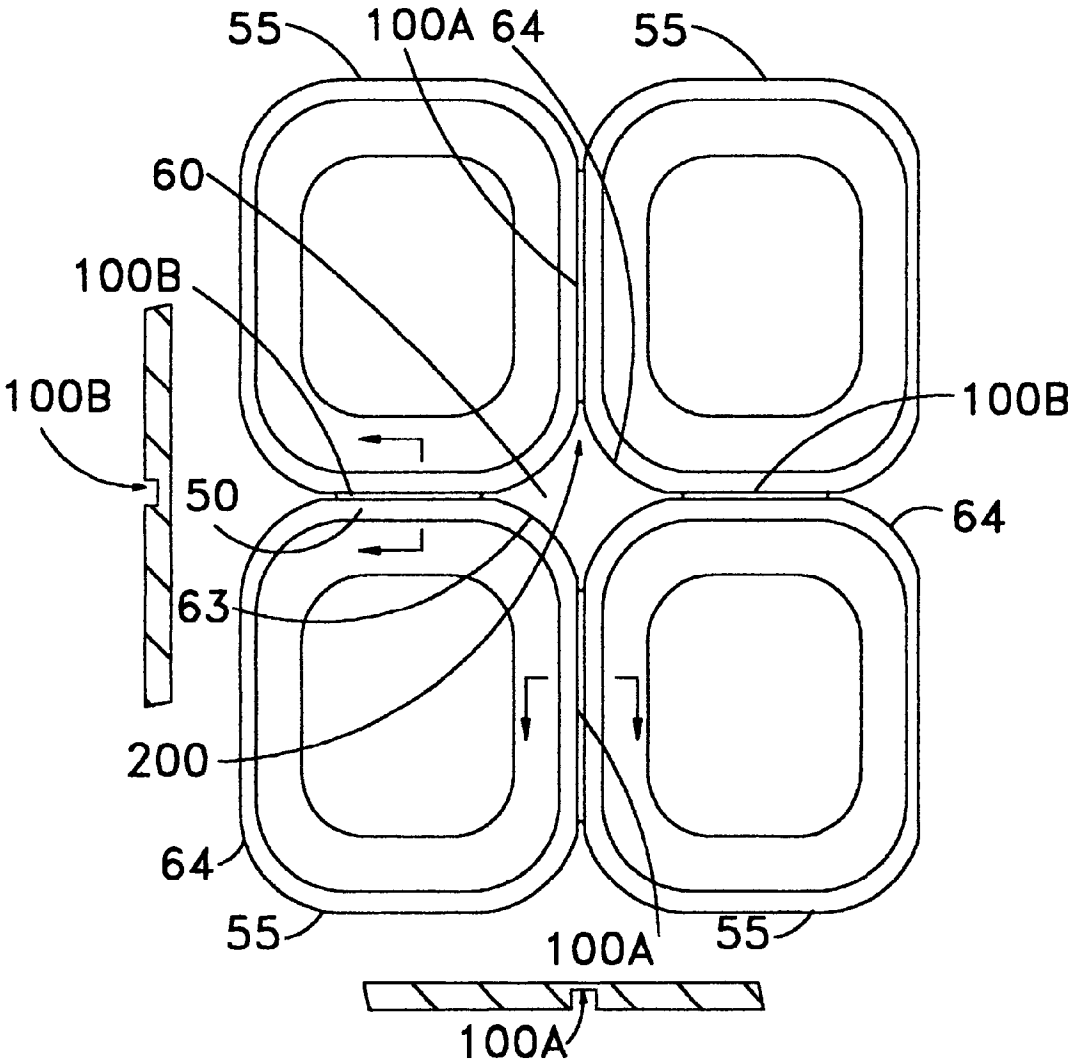
FIG. 3 is a top view of the multi-cellular container.
Figure 4:
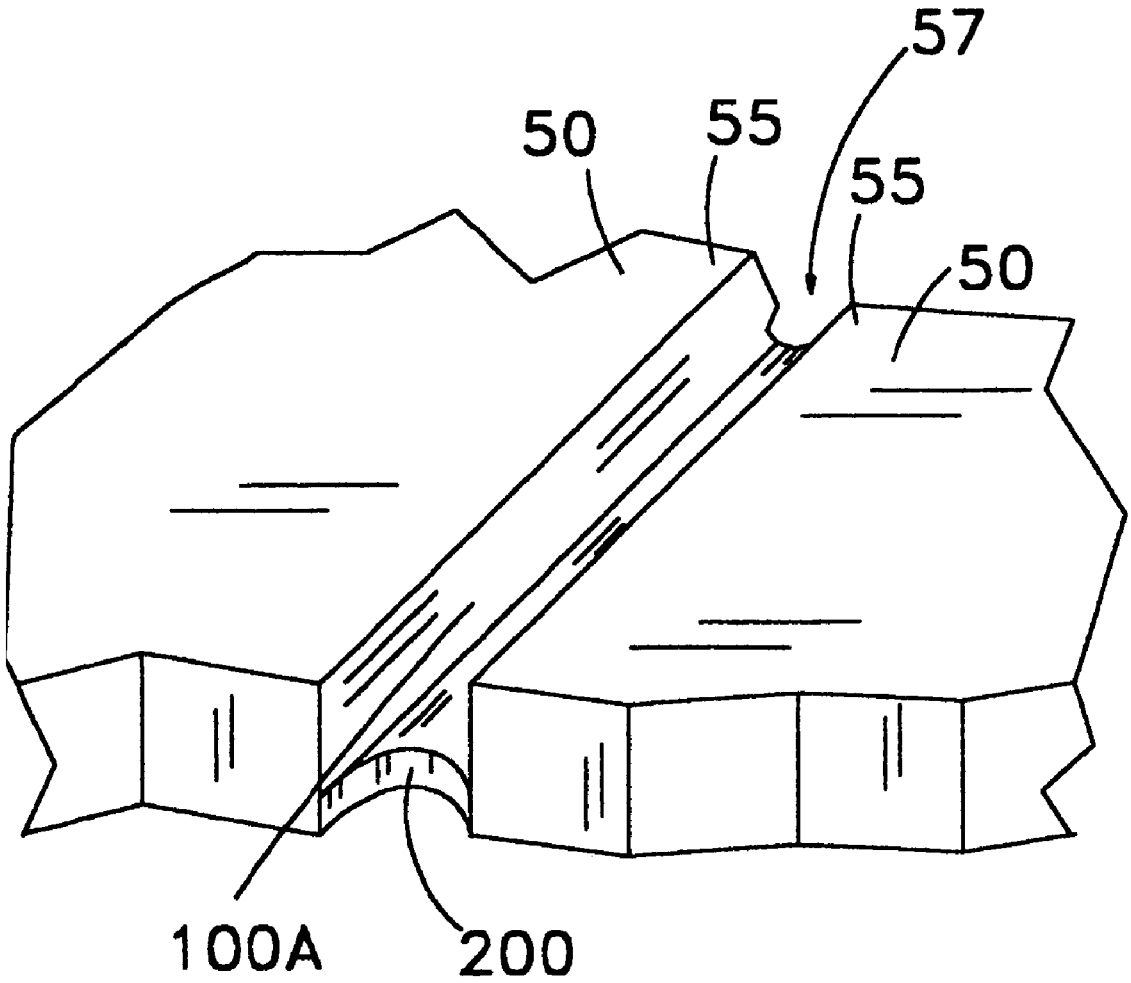
FIG. 4 is a close-up view of the deeper cut score of the multi-cellular container.
Figure 5:
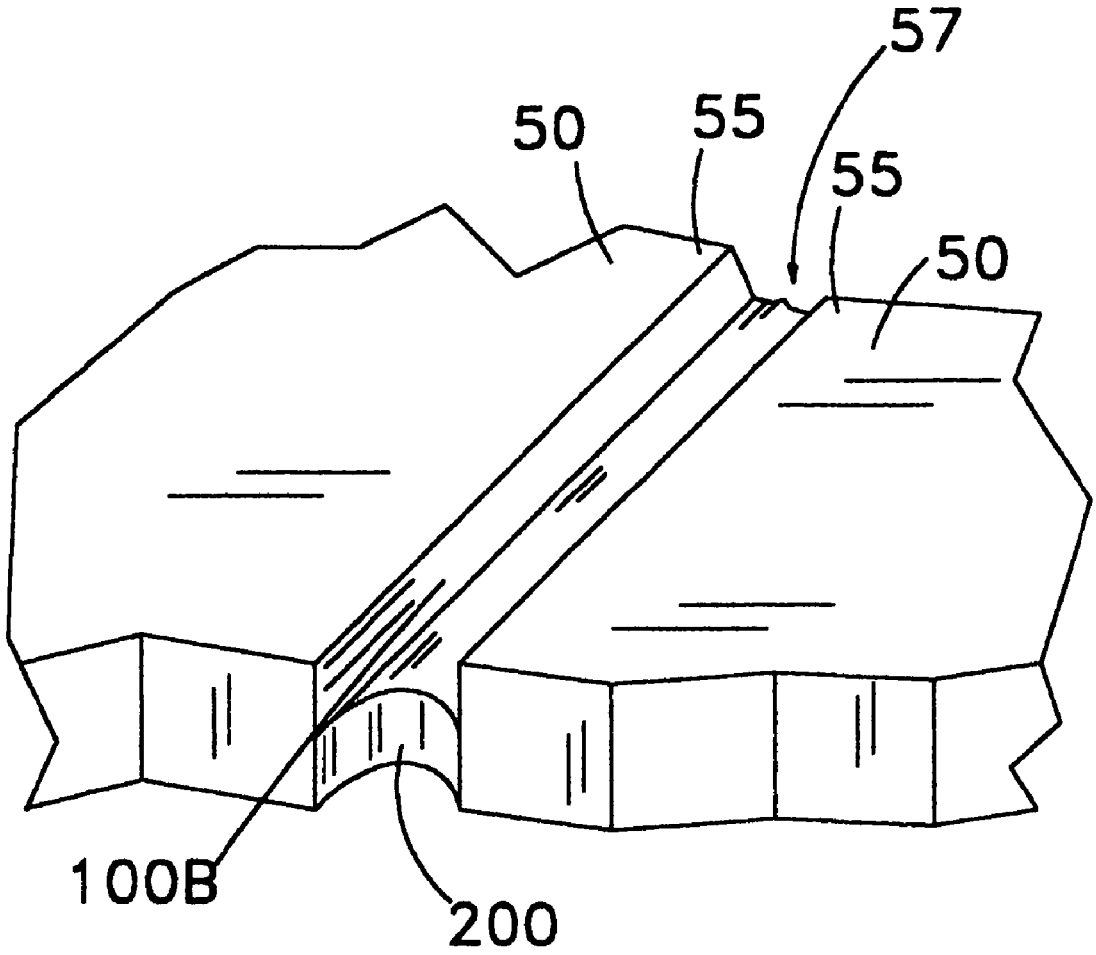
FIG. 5 is a close-up view of the shallower cut score of the multi-cellular container.
Figure 6:
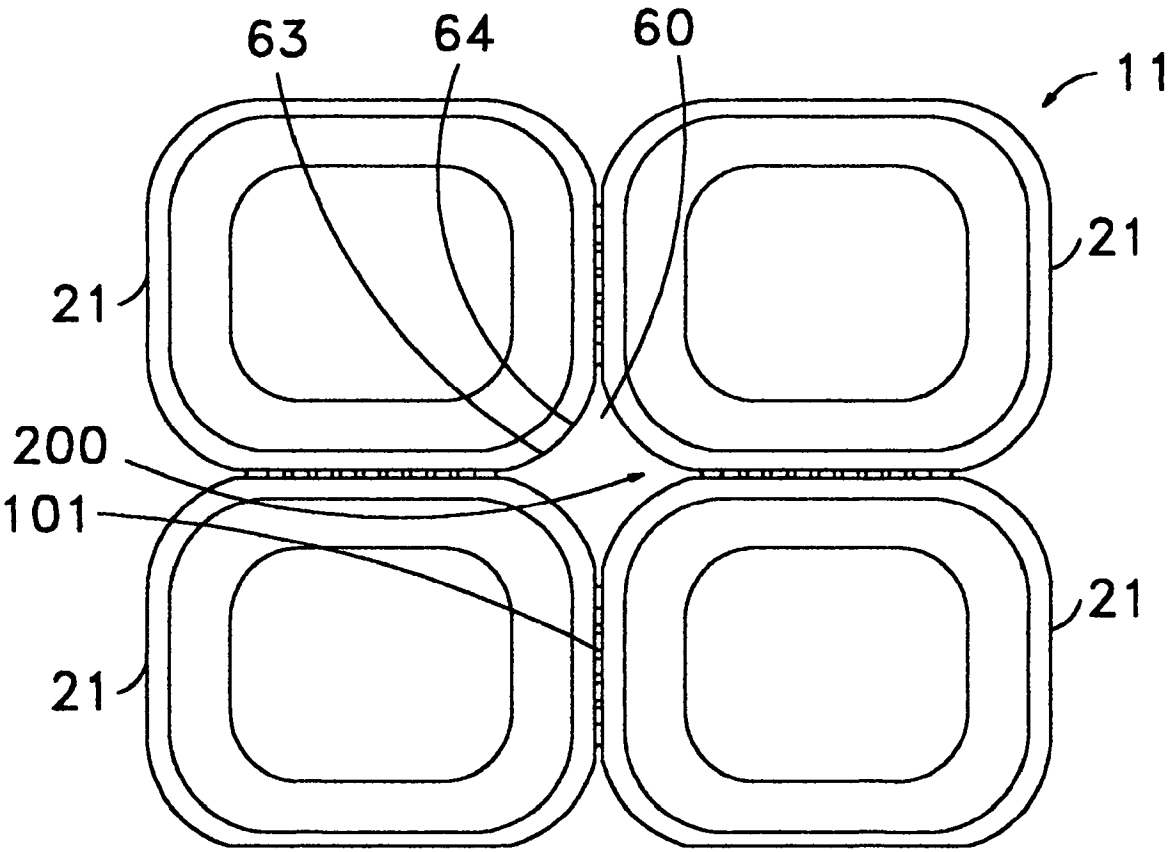
FIG. 6 is a top view of the second embodiment of the multi-cellular container.
Figure 7:
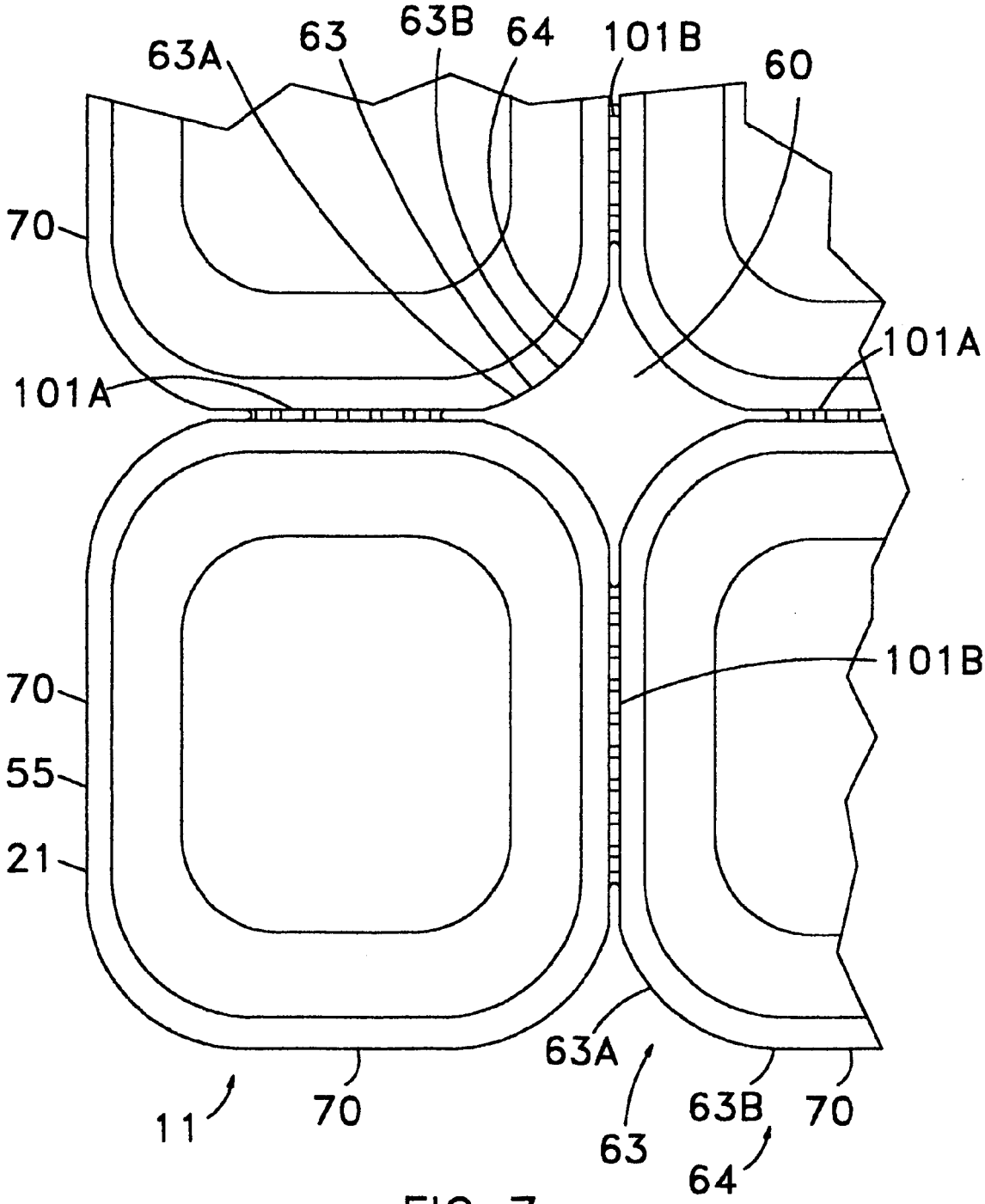
FIG. 7 is a close-up top view of the second embodiment of the multi-cellular container.
Figure 8:
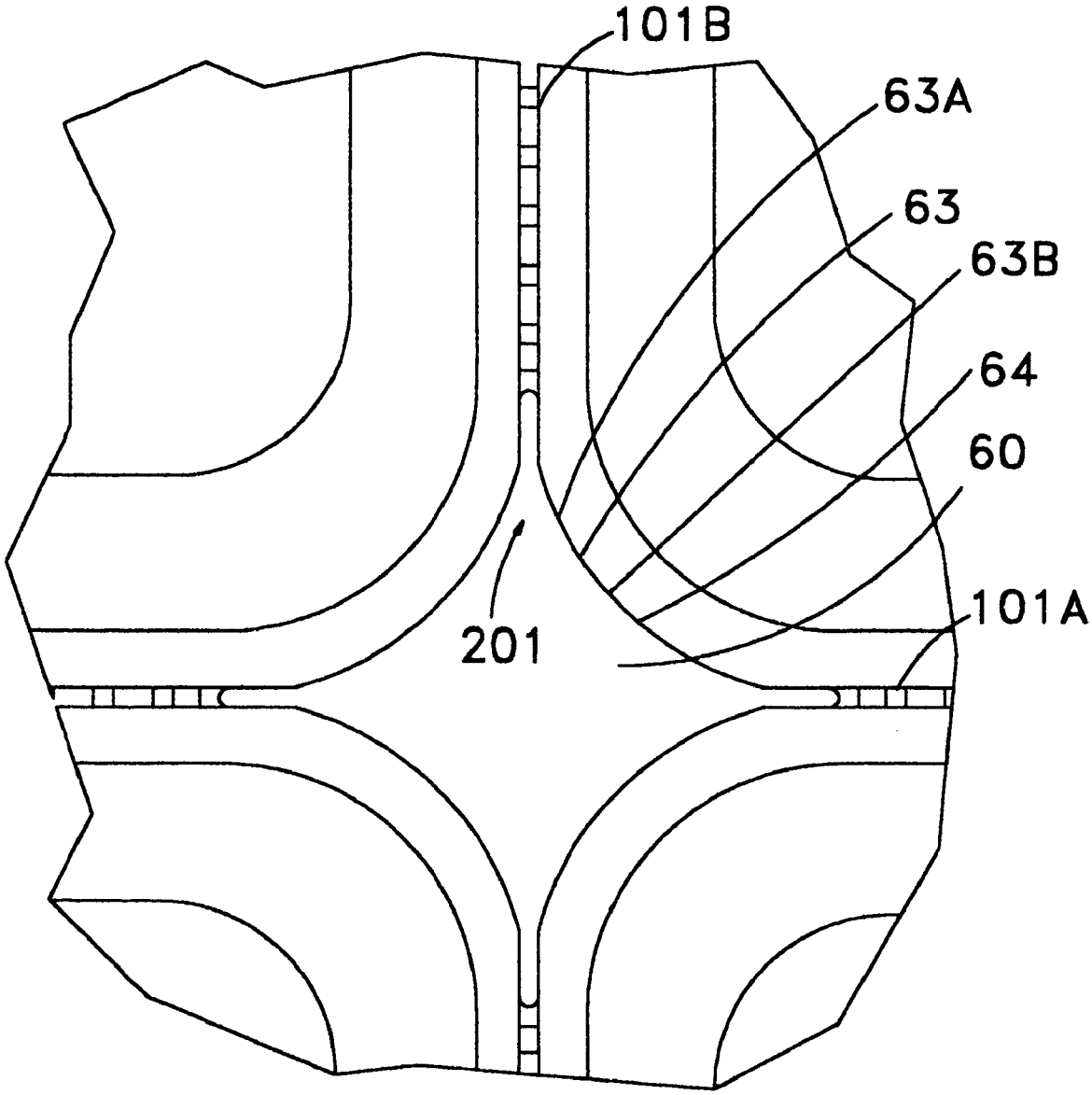
FIG. 8 is another close-up view of the second embodiment of the multi-cellular container.
Figure 9:
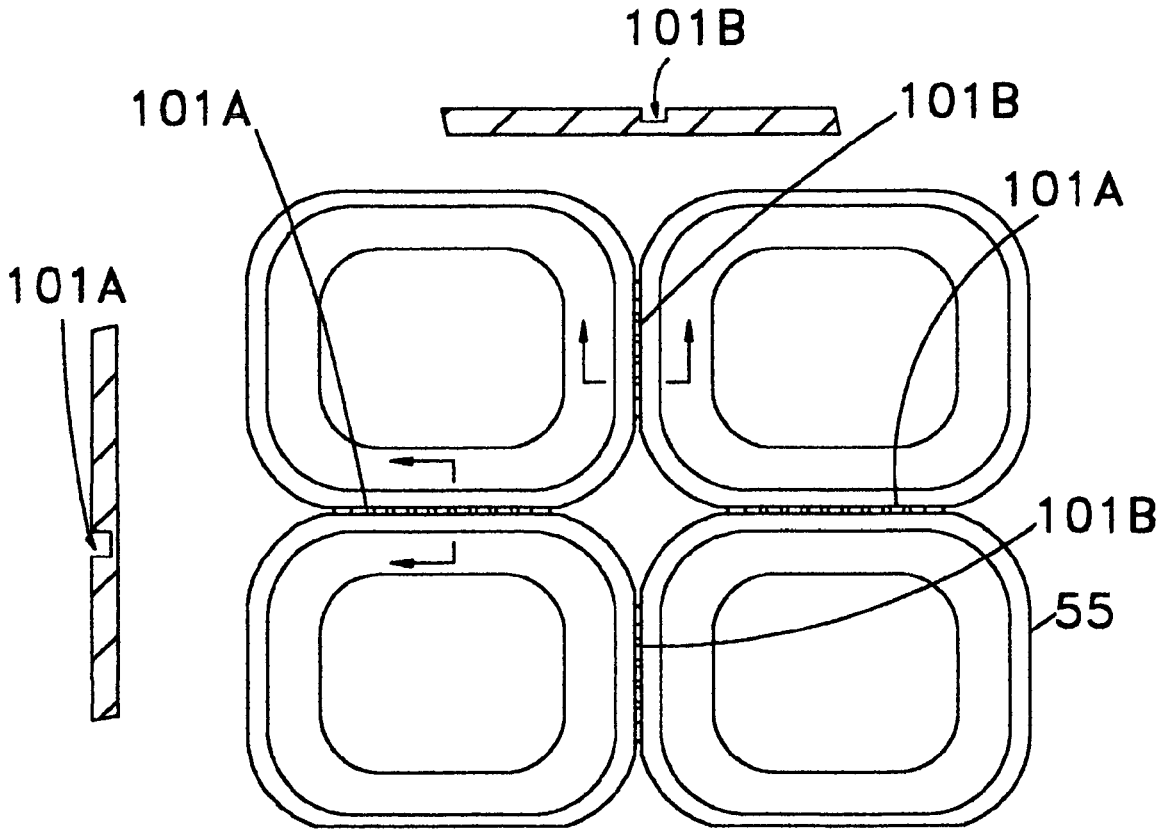
FIG. 9 is a top view of the second embodiment of the multi-cellular container showing the different depths of the alternating cut-score.
Figure 10:
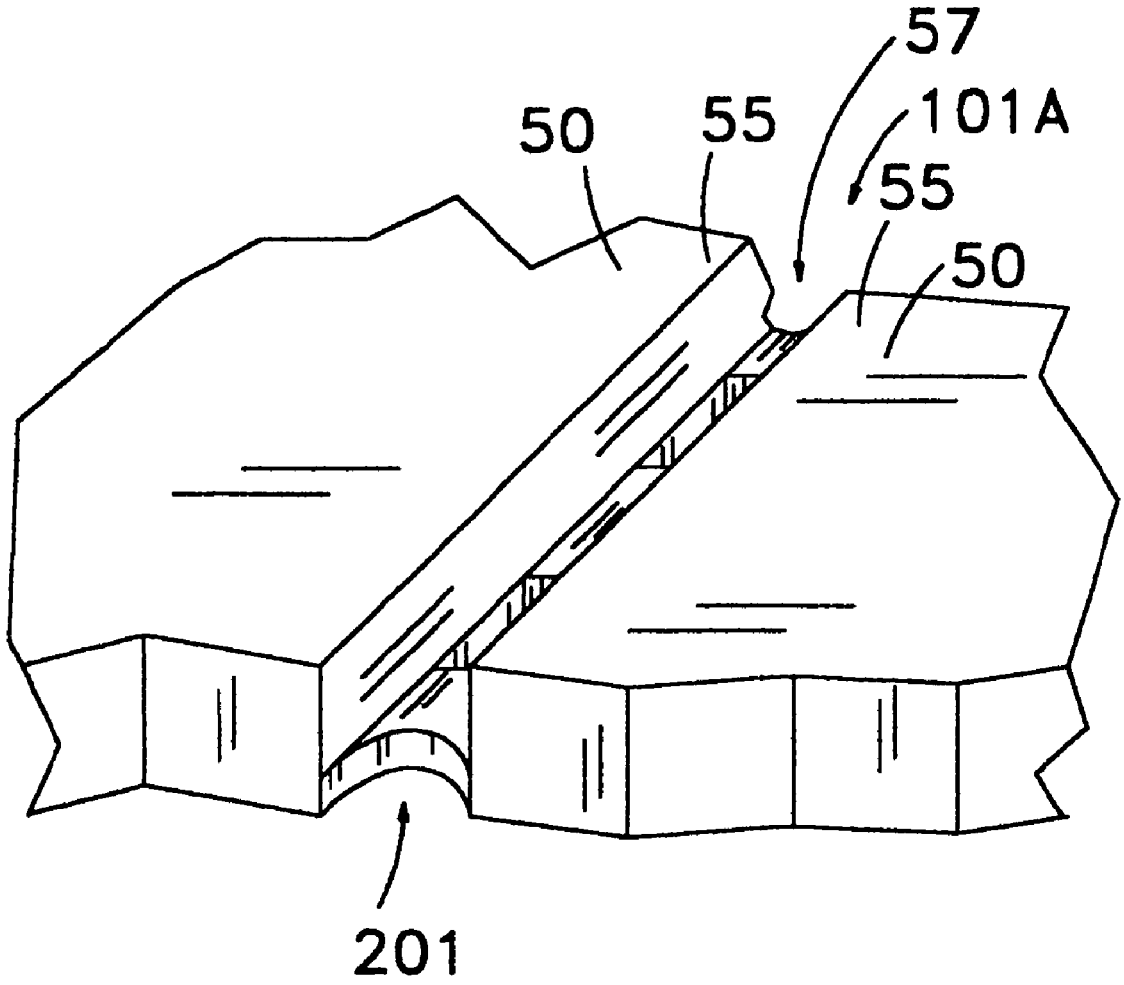
FIG. 10 is a view of the deeper alternating cut-score of the second embodiment of the multi-cellular container.
Figure 11:
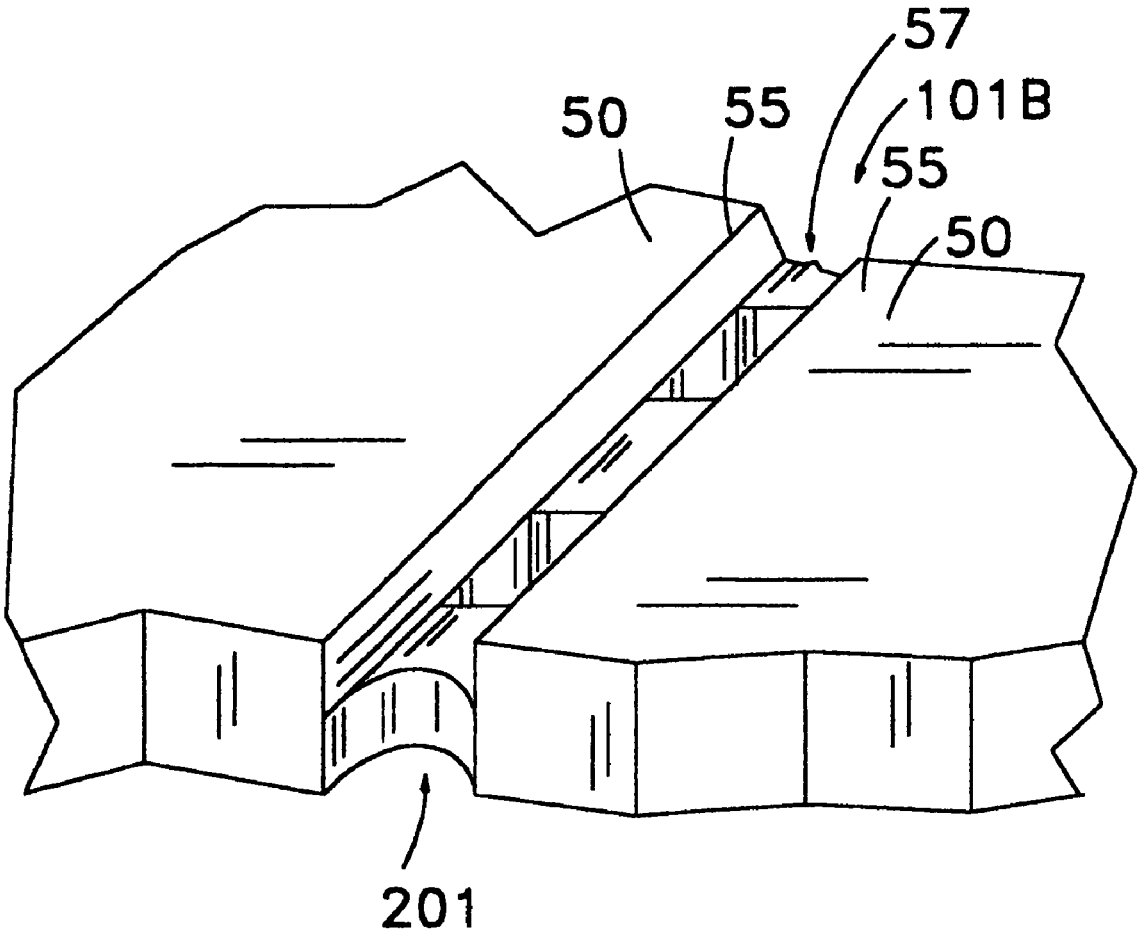
FIG. 11 is a view of the shallower alternating cut-score of the second embodiment of the multi-cellular container.
Figure 12:
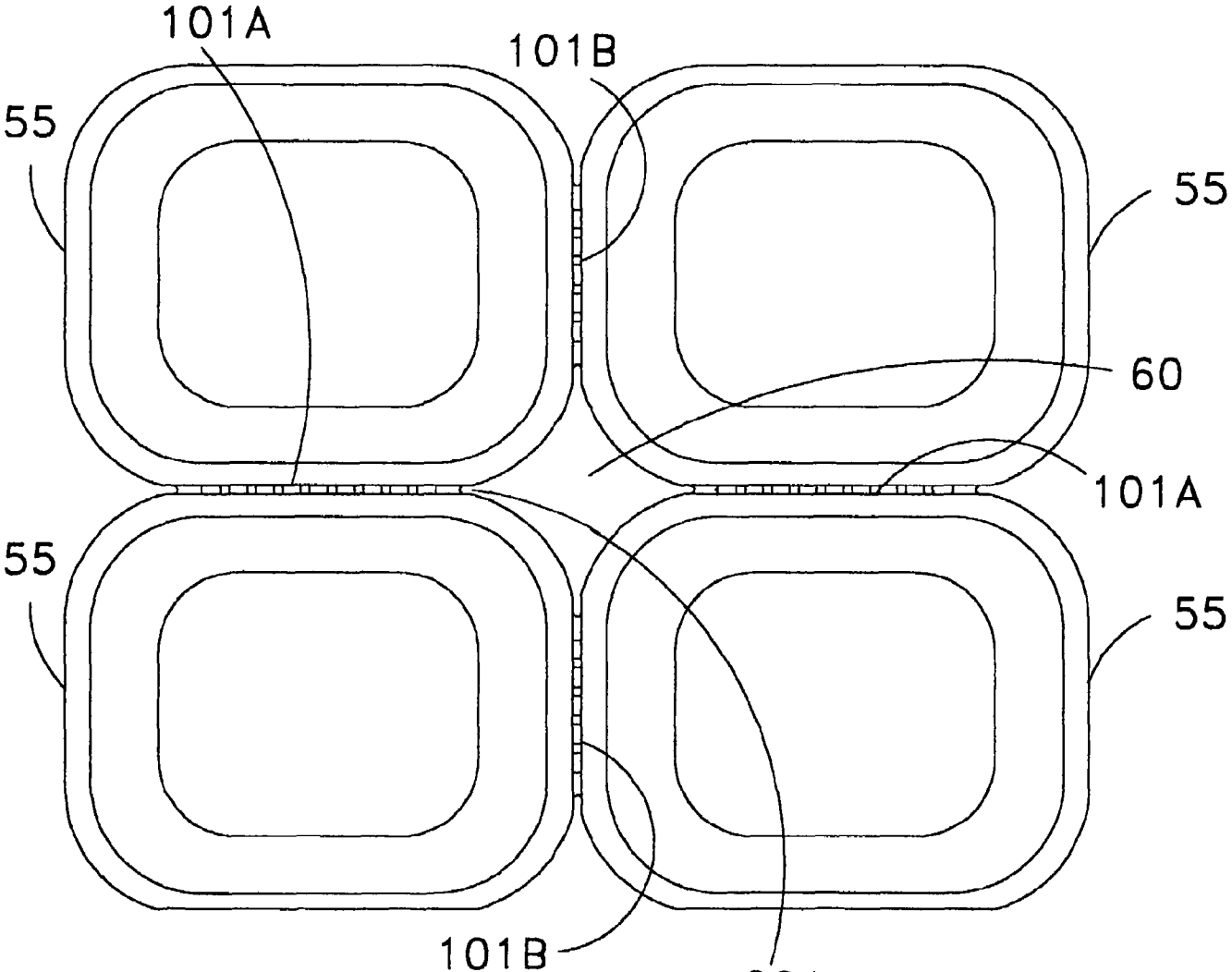
FIG. 12 is another top view of the second embodiment of the multi-cellular container.

The present invention relates to a multi-cellular polypropylene container with a separation region connecting the cells of the container. An individual cell may be torn from the remaining cells. A perimeter of the individual cell is generally smooth. The present invention further relates to a process for manufacturing thermoformed polypropylene multi-cellular containers.

The present invention includes a multi-cellular polypropylene container with a plurality of cells having the cut-scored region connecting the cells of the container. An individual cell may be removed by grasping the individual cell and tearing the separation region between the individual cell and the plurality of cells. The separation region holds the cells together for packaging, transportation, merchandising, and marketing purposes, but allows the cells to be separated for consumption purposes.

An individual cell removed from the plurality of cells at the separation region has a perimeter formed from the separation region, wherein the perimeter has a generally smooth edge. The perimeter is generally free of protrusions that extend from the perimeter or of serrated surfaces. This provides a consumer friendly product suitable for both children and adults.

The separation region comprises a cut-score. The cut-score may have different depths, with the cut-score being deeper in an index direction and the cut-score being shallower when the cut-score is perpendicular to the index direction. By varying the cut-score depths depending on the orientation of the plastic material, greater consistency in the tearability of the individual cells is achieved. The cut-score may also include a cut-through or an alternating cut-through.

The present invention further includes a multi-cellular container, comprising a plurality of cells connected together by a separation region, wherein an individual cell may be removed by tearing the separation region between the individual cell and the plurality of cells. A plurality of star-cut patterns is provided between the plurality of cells, and the star-cut patterns have curved and generally smooth edges that lead to the separation region. The curved edges with their generally smooth surface provide a cell that does not cut or snag the user after the cell is removed from the plurality of cells. The curved edges are free of sharp angles that could form sharp, dangerous corners.

The multi-cellular containers allow the retailer to sell a product that may be incrementally used by the consumer without fear of spoilage. Dry food goods may be conveniently transported and stored. Each cell may contain the food item. Each cell is sealed by a plastic or a foil film. An adhesive may be used to seal the film to the cells. The remainder of the cells are not "opened" by the removal of an individual cell; thus, the remainder of the dry food goods will still remain preserved in their original packaging for later use. In other embodiments, a single over-cap lid may cover the entire multi-cellular container. In still further embodiments, the multi-cellular container may be sealed with paperboard.

By using the cut-scoring in separation regions between each cell, the user can tear along the cut-score to remove an individual cell from the remaining cells without leaving sharp edges. The cut scoring between the cells provides a smoother edge to the individual cell and to the remaining cells, as opposed to the rough and hazardous edge resulting from perforating the cells, which could result in a cell having a serrated surface that is hazardous. Instead, the generally smooth edge of the individual cells and the remaining cells of the present invention do not have a serrated surface.

In some embodiments, the present invention includes alternating the cut-score with a cut-through. This provides further manufacturing control over the force need to separate the individual cells. This provides another way to fine-tune the tearability of the individual cells.

The single sheet of plastic material is heated and molded through conventional thermoforming processes to form the multi-cellular container. The cells are depressions in the single sheet of plastic material. Boundaries are maintained in the plastic material between the cells. These boundaries form the separation regions that receive the cut-score, and after separation of the cells, the boundaries form rims for each cellular container.

The present invention also includes a "cut-through" at the beginning of the cut-score and at the end of the cut-score to enhance the tear-ability of the polypropylene plastic. The cut-through portion is a complete cut-through the plastic and assists the user in starting the tearing-off of the individual cell. The cut-through provides the user a "start," that reduces the force that must be applied to separate the cells.

The present invention further includes star-cut patterns at the corner of each molded cell so that the corners are not sharp. The star-cut patterns have curved edges that lead to the separation region. This provides corners for the cells formed by a radius. The corners do not have straight edges or sharp corners. Importantly, the curved and generally smooth edges of the star-cut patterns form the beginning and ending cut-throughs in the separation region. This prevents the formation of a "hook" or a "corner" on the individual cell or the remaining cell(s) that could snag on or injure the user.

The plastic sheet is preferably polypropylene. Specific suitable polypropylenes include homopolymer, copolymer, and blends thereof. These polypropylenes are well suited for this application because they are chemically inert for food applications. Further, these polypropylenes provide a durable container that resists cracking and breaking. The polypropylene materials also do not transfer a "plastic" taste to the food items. The polypropylene films are also impervious to oil and chemically resistant to food items. Another suitable resin is amorphous polyethylene terephthalate.

The present invention includes varying the depth of the cut-score in relation to the orientation of the thermoformed plastic. The grain of the plastic is different in the index direction of the plastic sheet and perpendicular to that direction. This results from the extrusion process forming the plastic sheet of material. This is important when cut-scoring the plastic. Cut-scores made in the index direction of the plastic must be cut deeper to achieve the same tearability as cut-scores made perpendicular to the index direction. This allows the tearing of one of the cells to be performed with approximately the same amount of force, whether it is with the grain or across the grain of the thermoformed container. Consumers will appreciate not having some cells that are "hard" to remove and some cells that are "easy" to remove.

The multi-cellular container comprises two or more individual cells connected by the cut-score. For packaging purposes, the multi-cellular container will generally comprise an even number of individual cells. Multi-cellular containers with an odd number of individual cells are also included in the invention. Embodiments with two to eight individual cells are especially preferred for food packaging applications. However, the present invention is not limited to any particular number of cells. Embodiments with four cells are show in the drawings.

The polypropylene used in the container has a thickness of approximately 0.01 inches to approximately 0.05 inches. The thickness may vary depending upon the food packaging application. Thicker materials may be used for heavier food products.

As discussed above, the depth of the cut-score is varied depending on its positioning in the plastic material relative to the index direction of the thermoformed plastic. The cut-score in the index direction is deeper and may be approximately 0.006 inches to approximately 0.01 inches for many retail food packaging applications. The cut score perpendicular to the index direction may be approximately 0.003 inches to approximately 0.007 inches for many retail food packaging applications. The cut-score depths described are provided as examples, and will vary depending on the specific plastic sheet material used and the preferences of the manufacturer, retailer and consumer. One of the ordinary skill in the art will readily be able to adjust the respective cut-score depths according to their specific application.

The multi-cellular container is preferably a matrix of individual cells. The matrix is generally formed from a single sheet of material. In some embodiments, the matrix has a rectangular shape. Other embodiments may include a round or ovular shape. When the rectangular matrix is formed from the plastic material, the rectangular matrix should be orientated to the index direction of the plastic material such that cut-scores generally parallel to the index direction are deeper than cut-scores generally perpendicular to the index direction. The rectangular matrix will have a plurality of cut-scores generally parallel to the index direction and a plurality of cut-scores generally perpendicular to the cut-scores.

The film used to cover the multi-cellular container may be a plastic film made from plastic resin or a foil film. Suitable plastic resins include polypropylene, polyester, and polyethylene. Multiple layers of film may be used in a laminate structure. The film should prevent oxygen molecules from entering the container.

The film is bonded to the multi-cellular container by the use of heat and pressure, such as from a sealing machine. An optional additional adhesive layer may be applied to the tray.

The multi-cellular container may be manufactured using conventional thermoforming and trimming equipment.

Some embodiments of the present invention will now be described with reference to the Figures:

Turning to FIGS. 1-5, a multi-cellular container 10 is shown with four cells 20. The cells 20 are formed by thermoforming a single sheet of polypropylene. The cells 20 are cup-like depressions thermoformed into the single sheet of polypropylene. The cells 20 have a bottom 23 integral with sides 26. The sides 26 are generally at an angle or curved relative to the bottom 23 to form a receiving and holding structure for the food product.

The sides 26 transition or flair into a generally planar boundary 50 that assists in forming a perimeter or rim 55 for each cell 20 after the cells 20 are separated. The cells 20 are connected by the boundary 50, and the boundary 50 also forms a separation region 57 that includes a cut-score 100. The cells 20 are separated from the multi-cellular container 10 at the cut-score 100 of the separation region 57. The cut-score 100 is torn to separate the cells 20. The cut-score 100 forms the generally smooth surface of the perimeter or rim 50. The cells 20 include a star-shaped cut-out 60. The cells 20 are covered by a film 500.

The polypropylene sheet used in the multi-cellular container 10 has a thickness of approximately 0.03 inches.

The cut-score 100 begins with a cut-through 200 at each end of the cut-score 100. The cut-through 200 provides a start to reduce the force necessary to separate the cells 20. In this embodiment, a cut score 100*a* in the index direction is approximately 0.008 inches deep, and a cut score 100*b* perpendicular to the index direction is approximately 0.005 inches deep.

The star shaped cut-out 60 also prevents a sharp corner or a hook from forming when the cells 20 are separated. The star shaped cut-out 60 forms a curved edge 63 that transitions into the separation region 57 and forms the cut-through 200. Preferably, the curved edge 63 does not have sharp angles that may form a sharp edge to cut or snag the user. The curved edges 63 form rounded corners 64 for the cells 20.

Each cell 20 is a cup-like structure that may receive a food product. The shape and dimensions of the cell 20 may vary depending on manufacturing preferences and the specific food application.

Turning now to FIGS. 6-11, another embodiment of the present invention is illustrated. Like reference numerals are used to represent like features of the first embodiment. A container 11 comprising cells 21 is shown. The separation region 57 between the cells 21 includes a combination of cut scores 101 and cut-throughs 201. The separation region includes alternating the cut-scores 101 and the cut-throughs 201. In this embodiment, the cut-throughs 201 are located in the cut scores 101. This provides further means to control the tearability of the cells 21 from the container 11. In this embodiment, the cut-scores 101 are approximately 0.090 inches in length and the cut-throughs 201 are approximately 0.250 inches in length. In this embodiment, the cut score 101*a* in the index direction is approximately 0.008 inches deep, and the cut score 101*b* perpendicular to the index direction is approximately 0.005 inches deep. Of course, one of ordinary skill in the art may adjust these lengths and depths depending upon the specific application and packaging needs.

Figure 13:
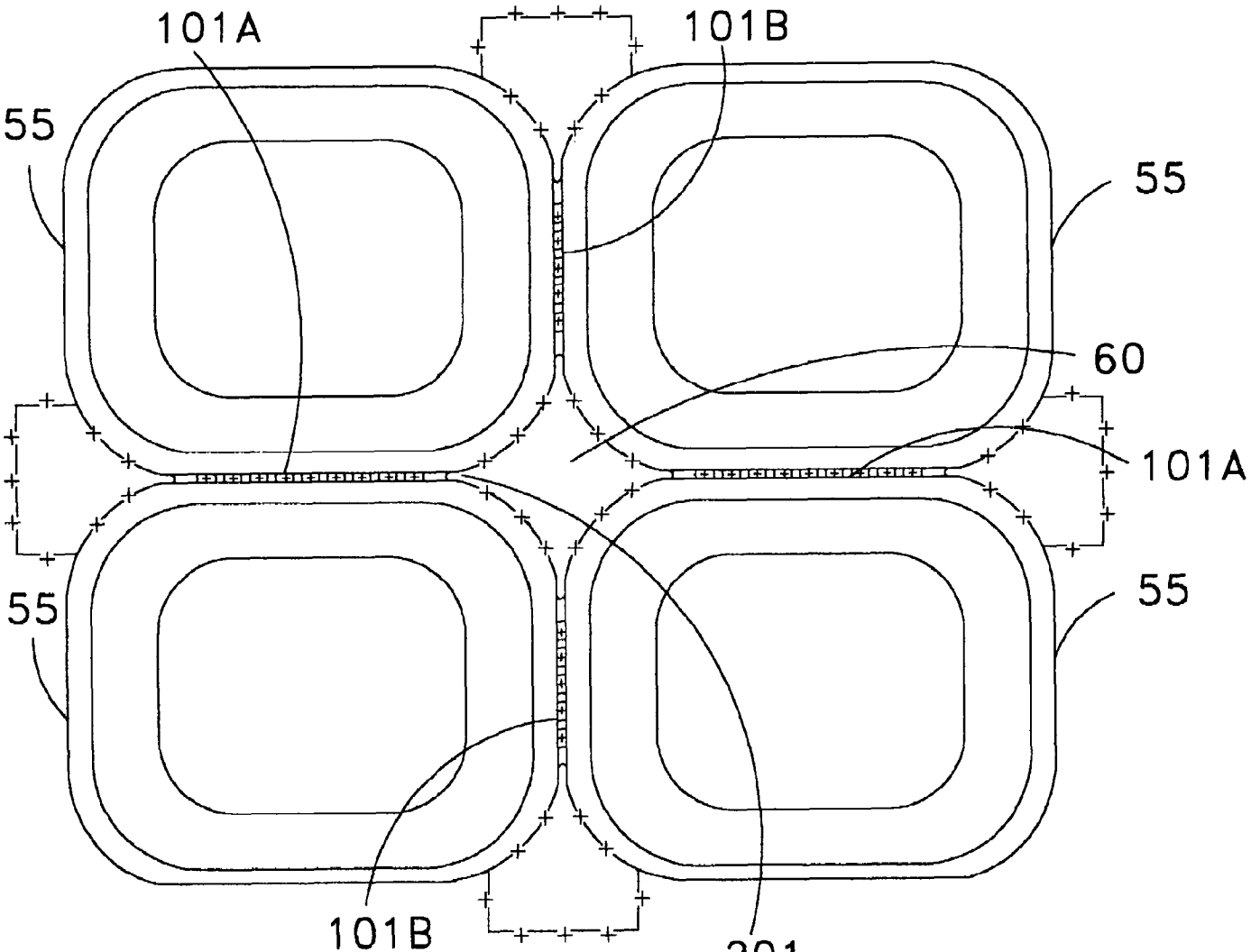
FIGS. 13-15 show the process used to form the second embodiment of the multi-cellular container.
Figure 14:
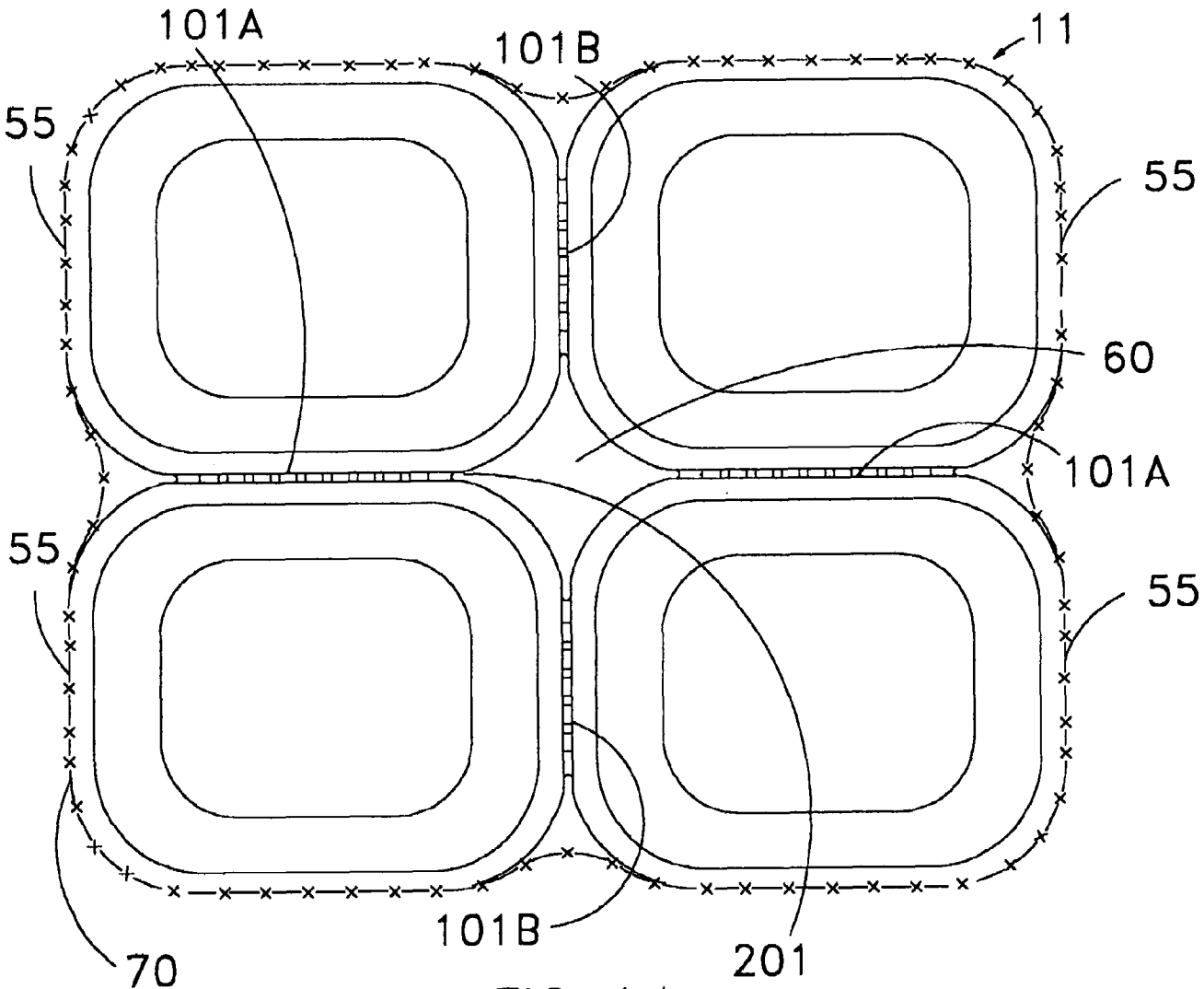
Figure 15:
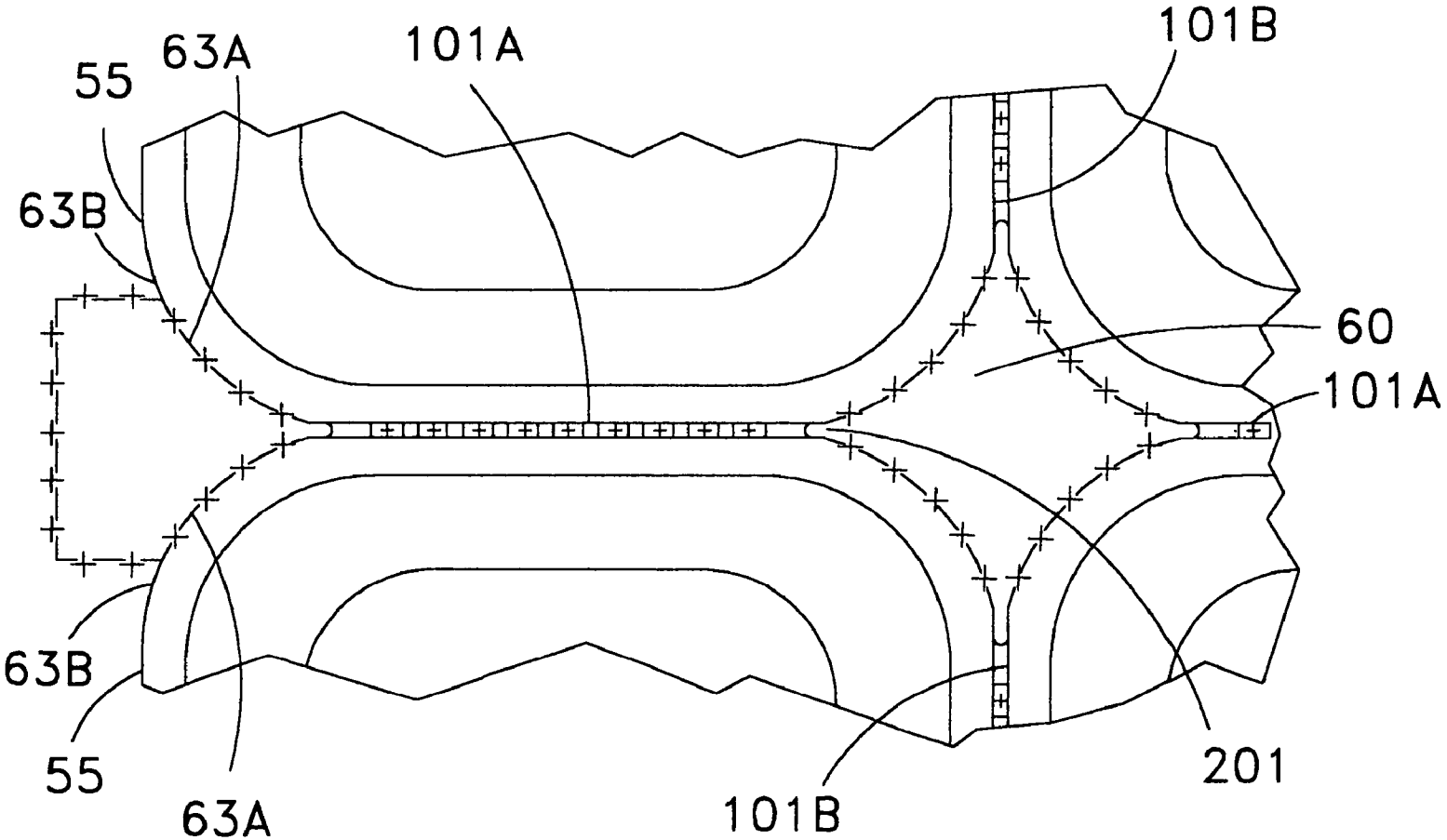

The present invention also includes a method of manufacturing the multi-cellular containers 10 and 11. This method of manufacturing is illustrated in FIGS. 12-15. First, a vertical trim press is used to cut the star shaped cut-outs 60, cut scores 100, 101, and the cut throughs 200, 201, and an inner portion 63*a* of the curved edge 63. The cuts made by the vertical trim press are shown in FIGS. 13-15 by the "+" characters, which are shown for illustrative purposes of which cuts are made. The vertical trim press cuts the star cut-out 60, and the cut scores 100, 101 and the cut throughs 200, 201 one row at a time in the single sheet of polypropylene.

Next, a horizontal trim press is used to cut an outer portion 63*b* of the curved edge 63 and outer edges 70 of the multi-cellular container 10. The outer portion 63*b* transitions into the rounded corners 64. In the same step, the horizontal trim press also cuts the outer edges 70. The cuts made by the horizontal trim press are shown in FIGS. 12-15 by the "x" characters, which are shown for illustrative purposes of which cuts are made. The outer edges 70 should be generally smooth, and there should not be any sharp corners between the outer edges 70 and the rounded corners 64. The inner portion 63*a* of the curved edge 63 should smoothly transition into the outer portion 63*b* of the curved edge 63 to prevent the formation of any sharp corners that could injure the user. Although the two step process is illustrated for manufacturing the container 11 with the combination of cut-scores 101 and cut-throughs 201, the two step process may be used to manufacture container 10.

This combination of the two cutting steps provides an efficient process to manufacture the multi-cellular container in an automated manner. Importantly, the two-step cutting process provides for precision needed for manufacturing the multi-cellular container of the present invention.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

What is claimed:

1. A method of manufacturing a multi-cellular container from a plastic sheet, comprising:

forming a plurality of cells connected together by a separation region, wherein an individual cell may be removed by tearing the separation region between the individual cell and the plurality of cells; and providing cut-scores between the plurality of cells, wherein the cut-scores parallel to an index direction of the plastic sheet are deeper than the cut-scores perpendicular to the index direction.

2. The method of manufacturing a multi-cellular container according to claim 1, further comprising forming star-cut patterns between the plurality of cells.

3. The method of manufacturing a multi-cellular container according to claim 2, further comprising forming the star-cut patterns with curved and generally smooth edges that lead to the separation region.

4. The method of manufacturing a multi-cellular container according to claim 3, wherein the curved and generally smooth edges provides corners for the cells having a radius.

5. The method of manufacturing a multi-cellular container according to claim 1, further comprising forming star-cut patterns between the plurality of cells without sharp corners.

6. The method of manufacturing a multi-cellular container according to claim 1, wherein the cut-scores and a star-cut pattern between the plurality of cells are cut before a perimeter of the multi-cellular container is cut.

7. The method of manufacturing a multi-cellular container according to claim 1, wherein the cut-scores and a star-cut pattern between the plurality of cells are cut by one trim press and a perimeter of the multi-cellular container is cut by another trim press.

8. The method of manufacturing a multi-cellular container according to claim 1, wherein the cut-scores and a star-cut pattern between the plurality of cells are cut in one step and a perimeter of the multi-cellular container is cut in another step.

9. The method of manufacturing a multi-cellular container according to claim 1, wherein the cut scores alternate with a cut-through.

10. The method of manufacturing a multi-cellular container according to claim 1, wherein the cut-scores between the individual cells includes a cut-through at the beginning of the cut-scores.

11. The method of manufacturing a multi-cellular container according to claim 1, further comprising forming the multi-cellular container with four cells.

12. The method of manufacturing a multi-cellular container according to claim 1, wherein an individual cell removed from the plurality of cells has a perimeter formed from the separation region, wherein the perimeter has a generally smooth edge.

13. A method of manufacturing a multi-cellular container, comprising:

forming a plurality of cells from a sheet of plastic, wherein the cells are connected together by a separation region, wherein an individual cell may be removed by tearing the separation region between the individual cell and the plurality of cells;

providing cut-scores in the separation region, wherein the cut-scores parallel to an index direction of the plastic material are deeper than the cut scores perpendicular to the index direction.

14. The method of manufacturing a multi-cellular container according to claim 13, further comprising thermoforming the plurality of cells from a sheet of polypropylene, wherein the cells are depressions having a bottom and sides, the sides are angled or curved relative to the bottom, the sides transition into a generally planar boundary that forms a rim for each cell, and the boundary comprises the separation region.

15. The method of manufacturing a multi-cellular container according to claim 13, further comprising forming alternating cut-throughs with the cut-scores in the separation region.

16. A method of manufacturing a multi-cellular container, comprising:

forming a plurality of cells from a sheet of plastic, wherein the cells are connected together by a separation region, wherein an individual cell may be removed by tearing the separation region between the individual cell and the plurality of cells;

cutting cut-scores in the separation region with one trim press, wherein the cut-scores parallel to an index direction of the sheet of plastic are deeper than the cut-scores perpendicular to the index direction;

cutting a star-cut pattern between the plurality of cells with the one trim press; and cutting a perimeter of the multi-cellular container with another trim press.

17. The method of manufacturing a multi-cellular container according to claim 16, wherein the cutting of the cut-scores and the cutting of the star-cut pattern between the plurality of cells occurs in one step and the cutting of the perimeter of the multi-cellular container occurs in another step.

18. The method of manufacturing a multi-cellular container according to claim 16, further comprising using a vertical trim press to cut the star-cut pattern, the cut scores, and an inner portion of a curved edge that forms rounded corners for the cells, and further comprising using a horizontal trim press to cut an outer portion of the curved edge and outer edges of the multi-cellular container.

* * * * *